US007316465B2

(12) United States Patent
Kodama

(10) Patent No.: US 7,316,465 B2
(45) Date of Patent: Jan. 8, 2008

(54) LIQUID DISCHARGE APPARATUS AND INKJET RECORDING APPARATUS

(75) Inventor: Kenichi Kodama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 242 days.

(21) Appl. No.: 10/936,659

(22) Filed: Sep. 9, 2004

(65) Prior Publication Data

US 2005/0052486 A1 Mar. 10, 2005

(30) Foreign Application Priority Data

Sep. 10, 2003 (JP) ..... 2003-318547

(51) Int. Cl.
*B41J 29/38* (2006.01)

(52) U.S. Cl. ..... 347/14; 347/6; 347/17

(58) Field of Classification Search ..... 347/6, 347/14, 17

See application file for complete search history.

(56) References Cited

U.S. PATENT DOCUMENTS

| | | | |
|---|---|---|---|
| 5,517,284 A | 5/1996 | Ohtake et al. | |
| 6,412,928 B1 * | 7/2002 | Anagnostopoulos et al. | 347/77 |
| 2002/0097300 A1 | 7/2002 | Silverbrook | |

FOREIGN PATENT DOCUMENTS

| | | | |
|---|---|---|---|
| EP | 0 811 490 | A | 12/1997 |
| JP | 55-113578 | | 9/1980 |
| JP | 57-148660 | A | 9/1982 |
| JP | 02-030539 | A | 1/1990 |
| JP | 2-134565 | U | 11/1990 |
| JP | 6-91893 | A | 4/1994 |
| JP | 6-194995 | A | 7/1994 |
| JP | 8-336947 | A | 12/1996 |
| JP | 10-286947 | A | 10/1998 |
| JP | 11-1003 | A | 1/1999 |
| JP | 11-10878 | A | 1/1999 |
| JP | 11-42774 | A | 2/1999 |
| JP | 2003-136756 | A | 5/2003 |

* cited by examiner

*Primary Examiner*—Thinh Nguyen
(74) *Attorney, Agent, or Firm*—Birch, Stewart, Kolasch & Birch, LLP

(57) ABSTRACT

The liquid discharge apparatus discharges liquid from an orifice of a nozzle portion, and comprises: a nozzle-portion heating device which heats the nozzle portion; and a nozzle heating control device which controls a heating timing by the nozzle-portion heating device in accordance with a discharge drive timing for discharging the liquid from the orifice of the nozzle portion.

7 Claims, 14 Drawing Sheets

51
120
122

24
t=Tn
132

126
120

LIQUID DISCHARGE APPARATUS AND INKJET RECORDING APPARATUS

This Non-provisional application claims priority under 35 U.S.C. § 119(a) on patent application Ser. No(s). 2003-318547 filed in Japan on Sep. 10, 2003, the entire contents of which are hereby incorporated by reference.

BACKGROUND OF THE INVENTION

1. Field of the Invention

The present invention relates to a liquid discharge apparatus and an inkjet recording apparatus, and more particularly to a structure for a discharge head suitable for realizing a stable liquid discharge and a technology of drive control thereof.

2. Description of the Related Art

Inkjet recording apparatuses deposit ink droplets on a recording medium by relatively moving recording paper or another recording medium with respect to a recording head provided with ink discharge nozzles while discharging ink from the recording head in accordance with a print signal, and an image is formed on the printing medium by the ink dots. The inkjet recording apparatuses stop discharging ink or experience other discharge defects when the viscosity of the ink increases inside the nozzles due to drying or the like. The resupply performance (refill performance) of ink to the nozzles is reduced when the ink viscosity increases.

In view of the above, Japanese Patent Application Publication No. 11-10878, in a so-called thermal-jet (side shooter, in particular) inkjet printing apparatus in which a thermal-expansion heater for generating the thermal energy required for discharge is disposed in an ink flow channel, proposes technology for improving the discharge and refill performance by disposing a first thermal heater in a position near the discharge port inside the ink flow channel, disposing a second thermal heater in a position farther from the discharge port than the thermal-expansion heater, and controlling the viscosity of the ink by means of these two thermal heaters.

Japanese Patent Application Publication No. 6-91893 discloses an inkjet printer provided with a head heater for heating the entire head, and an ink chamber heater for heating each ink chamber individually.

The method proposed in Japanese Patent Application Publication No. 6-91893 focuses on the ink temperature in the discharge direction and controls the viscosity and volume of the ink, but in accordance with this method, the entire head must be warmed in order to obtain liquid properties that are adequate for discharge, so a considerable amount of energy is required. In particular, initial heating is required from power-on until the first printing operation is possible.

In accordance with the method disclosed in Japanese Patent Application Publication No. 11-10878 concerning this point, the entire head is not required to be heated because the structure provides thermal heater to individual flow channels. Nevertheless, the method proposed in Japanese Patent Application Publication No. 11-10878 has a structure in which thermal heaters are disposed in close proximity at intervals of several tens of micrometers on the discharge side and supply side with respect to the ink flow channel in the same plane, so there is a drawback in that as the number of discharges increases, the temperature difference between these two heaters grows smaller, and the effect of higher discharge strength is lessened. Furthermore, the structure disclosed in Japanese Patent Application Publication No. 11-10878 is a discharge type that uses expansion produced by thermal resistors, and has a thermal-expansion heater for high temperature heating that is more powerful than a thermal heater. The thermal heater is disposed in a very close positional relationship forward and rearward of this heater, so there is a drawback in that the temperature difference between the heaters is even smaller.

SUMMARY OF THE INVENTION

The present invention has been implemented taking into account the above described circumstances, and an object thereof is to provide a liquid discharge apparatus that can realize stable liquid discharge by controlling the liquid physical properties in the vicinity of the nozzles, can realize rapid refilling even with a high-viscosity ink, and can also maintain discharge and refilling performances, and an inkjet recording apparatus that uses this liquid discharge apparatus.

In order to achieve the above-described object, the present invention is directed to a liquid discharge apparatus which discharges liquid from an orifice of a nozzle portion, comprising: a nozzle-portion heating device which heats the nozzle portion; and a nozzle heating control device which controls a heating timing by the nozzle-portion heating device in accordance with a discharge drive timing for discharging the liquid from the orifice of the nozzle portion.

In accordance with the present invention, the temperature of the nozzle portion forming a fluid channel restricting a size of a droplet of the liquid to be discharged is adjusted in conjunction with the timing for discharging liquid from the orifice of the nozzle, so that the viscosity of the liquid inside the nozzles can be reduced with the minimum required amount of energy. The discharge performance can thereby be made stable with less energy than prior art when high-viscosity ink is involved.

The liquid discharge apparatus related to an aspect of the present invention further comprises a computing device which calculates a temperature rising time needed to bring a viscosity of the liquid inside the nozzle portion to a predetermined value or less according to temperature dependency characteristics of the viscosity of the liquid to be discharged and temperature rise characteristics of the liquid inside the nozzle portion; and a timing setting device which sets a drive timing of the nozzle-portion heating device in accordance with the temperature rising time calculated by the computing device.

In accordance with this aspect, suitable heat timing is calculated in order to obtain a predetermined viscosity during discharge in accordance with the type of liquid that is used. The temperature can thereby be reliably increased so that the liquid inside the nozzles achieves a viscosity that allows discharge.

In this case, there is an aspect in which the computing device further comprises: a first computational processing unit which determines a relationship between a desired viscosity and a required heating temperature of the liquid according to the temperature dependency characteristics of the viscosity of the liquid; and a second computational processing unit which determines the temperature rising time needed to heat the liquid to the required heating temperature according to the temperature rise characteristics of the liquid inside the nozzle portion.

There is an aspect in which the first computational processing unit has a first table showing the temperature dependency characteristics of the viscosity of the liquid; and the second computational processing unit has a second table showing the temperature rise characteristics of the liquid inside the nozzle portion. It is possible to handle a plurality of types of liquid by providing a first table correlated to the plurality of types of liquid.

As another aspect of the present invention, the nozzle heating control device controls the nozzle-portion heating device so as to heat the liquid inside the nozzle portion at a predetermined heating penetration depth from a wall face of the nozzle portion to a predetermined temperature. Liquid can be discharged from the orifice of the nozzle if at least the liquid in the vicinity of the wall face of the nozzles is heated to reduce its viscosity, so heating control that is sufficient to heat solely the liquid in the vicinity of the wall face of the nozzles should be carried out.

As a specific aspect, the heating penetration depth $\delta d$ preferably satisfies the following formula: $0.05 \leqq \delta d/D \leqq 0.15$, where D is the diameter of the nozzle portion.

Thus, the aspect in which solely the liquid in the vicinity of the wall face of the nozzles is heated allows energy to be saved in comparison with when all the ink in the nozzle portion is heated.

The liquid discharge apparatus related to yet another aspect of the present invention further comprising: a discharge head including: a plurality of nozzles, a plurality of pressure chambers respectively corresponding to the plurality of nozzles, and a common flow channel which feed the liquid to the plurality of pressure chambers through a plurality of supply channels respectively provided to the plurality of pressure chambers, wherein the nozzle-portion heating device is provided to the nozzle portion of each of the plurality of nozzles of the discharge head, and a supply-channel heating device is provided to each of the plurality of supply channels.

The liquid fed from the liquid supply source to the discharge head passes through the common flow channel inside the head and is delivered to the individual pressure chambers. An actuator, a heater for expansion heating, or another device (discharge drive element) for generating the discharge force of the liquid is disposed in the pressure chambers. In other words, the liquid passes from a common flow channel through the supply channels, flows into the individual pressure chambers, and is discharged from the pressure chambers to the exterior by way of the nozzles.

With consideration given to the entire flow channel inside the head, and cross-sectional area of the common flow channel or the flow channels in the pressure chambers is increased, and the cross-sectional area of the supply channels (supply hole) and the nozzle portion is made relatively small. Thus, discharge is made possible even with relatively high viscosity liquid by heating the nozzle portion and the supply channels with the relatively large flow resistance, and locally reducing the viscosity of the liquid. In accordance with this aspect, because of local heating, the responsiveness is high, the discharge frequency can be improved, and the amount of energy consumed can be reduced in comparison with the method of heating all of the ink.

Another aspect of the present invention further comprises a supply-channel heating control device which controls a heating timing by the supply-channel heating device in accordance with the discharge drive timing for discharging the liquid from the orifice of the nozzle portion.

An improvement in the discharge characteristics and the refill characteristics can be ensured by controlling the supply-channel heating device for heating the supply channels on the upstream side on both sides of the pressure chambers, and controlling the nozzle-portion heating device for heating the nozzle portion on the upstream side in association with the discharge drive timing.

For example, the discharge pressure of the pressure chambers can be efficiently applied in the discharge direction by increasing the temperature of the nozzle portion alone during discharge to lower the viscosity of the ink in the nozzle portion, and increasing the viscosity of the liquid in the vicinity of the supply channels in a relative fashion without heating the supply channels. Liquid flow from the supply channels is facilitated and refilling can be quickly performed by increasing the temperature in the area around the supply channels during refilling. Furthermore, after refilling is substantially complete, the heating in the nozzle portion is stopped and the viscosity of the liquid in the area around the nozzles is increased. The vibration of the meniscus generated by refilling can thereby be caused to rapidly converge.

A preferable aspect of the present invention is one in the plurality of nozzles, the plurality of pressure chambers, the common flow channel, and the plurality of supply channels are formed in layers; and in each of the plurality of nozzles, the nozzle and the supply channel are composed of members of different layers, and the nozzle-portion heating device and the supply-channel heating device are disposed in mutually different layers.

In accordance with this aspect, the nozzle-portion heating device and the supply-channel heating device are respectively disposed in mutually different layers in a bed in which nozzles, pressure chambers, a common flow channel, and supply channels are formed of a laminate structure composed of plate member (flow channel plate), so these heating devices can be disposed in a relatively separated positional relationship, and the mutual temperature effect can be eliminated. Therefore, the respective accuracies of the temperature adjustment can be increased, and the discharge and refilling performances can be maintained over a long period of time.

Another preferable aspect is one in which a heat insulation layer is provided between a flow channel plate (nozzle layer) in which the nozzle is formed and another flow channel plate (supply channel layer) in which the supply channel is formed.

Another aspect of the present invention provides an inkjet recording apparatus in which the above-described liquid discharge apparatus of the present invention is used as a discharge apparatus for ink droplets. In other words, the inkjet recording apparatus of the present invention forms an image on a recording medium by discharging ink from the orifice of the nozzle while the recording medium is relatively moved with respect to a recording head having the above orifice of the nozzle.

In the implementation of the present invention, the aspect of the recording head is not particularly limited, and also possible are a shuttle-scan print head for performing printing as the print head moves in a reciprocating fashion in a direction that is substantially orthogonal to the conveyance direction of the printing medium, and a full-line print head with one or more rows of nozzles in which a plurality of nozzles for discharging ink are arrayed across the entire width of a printing medium in a direction substantially orthogonal to the conveyance direction of the printing medium.

When the full-line recording head is a long head, there may be nozzles that are not used during printing, and conventional methods in which the entire head is heated tend to suffer from discharge defects because the ink in the unused nozzles dries out due to heating. For this reason, preventing the nozzles from drying out is a crucial issue. In accordance with the present invention, a nozzle portion is locally heated by a nozzle-portion heating device, so the entire head does not need to be heated, and the unused nozzles can be prevented from drying out. Therefore, the present invention is particularly effective when applied to a full-line recording head.

The nozzle array of a "full-line recording head" is normally disposed along the direction orthogonal to the relative conveyance direction (direction of relative movement) of the printing medium, but also possible is an aspect in which the recording head is disposed along the diagonal direction given a predetermined angle with respect to the direction orthogonal to the direction of relative movement. The array form of the nozzles in the recording head is not limited to a single row array in the form of a line, but a matrix array composed of a plurality of rows is also possible. Furthermore, also possible is an aspect in which a plurality of short-length recording head units having a row of nozzles that do not have lengths that correspond to the entire width of the printing medium are combined and the nozzle rows are configured so as to correspond to the entire width of the printing medium, with these units acting as a whole.

The term "printing medium" refers to a medium (media) that is printed on by a recording head, and may be referred to as an image formation medium, printing medium, image receiving medium, or the like. The medium includes continuous paper, cut paper, seal paper, OHP sheets, and other resin sheets, as well as film, cloth, and various other media without regard to materials or shapes.

The conveyance device for relatively moving the recording medium with respect to the recording head includes an aspect in which the printing medium is conveyed with respect to a stationary (fixed) recording head, an aspect in which the recording head is moved with respect to a stationary printing medium, or an aspect in which both the recording head and the printing medium are moved.

In the present specification, the term "printing" expresses the concept of not only the formation of characters, but also the formation of images with a broad meaning that includes characters.

In accordance with the present invention, a nozzle-portion heating device is provided to the nozzle portion that determines the size of the discharge droplets, and heating control for the nozzle portion is carried out in accordance with the discharge drive timing, so the viscosity of the liquid in the area around the nozzles can be reduced to a predetermined viscosity with a small amount of heating energy, and liquid can be easily discharged from the orifice of the nozzle.

In accordance with the present invention, the temperature of the nozzle portion is locally adjusted, so the heating time is short in comparison with a conventional mode in which the temperature of the entire head is adjusted, and the initial startup time from power-on until the first printing operation is possible can be shortened. Furthermore, the present invention can prevent unused nozzles from drying out, and can therefore be very effectively applied to liquid discharge apparatuses provided with a long discharge head that has a large number of nozzles.

A relatively large distance can be provided between the heating devices, and mutual temperature effects can be avoided with an aspect in which the nozzles, pressure chambers, common flow channel, and supply channels, which are required components for liquid discharge in the present invention, are formed of a laminated structure, and a nozzle-portion heating device and a supply-channel heating device are provided to a plate member (flow channel plate) with different layers. Therefore, heat can be transmitted to solely the area around the nozzles and the area around the supply channels (the area around the individual flow channels), and the effect of adjusting the temperature of the liquid can be maintained.

As an incidental effect in the present invention, discharged droplets can be effectively separated in harmony with the driving action of an actuator or another discharge drive element in a control aspect in which the nozzle-portion heating device is switched on just prior to discharge or is switched off around the time just after discharge in order to control the timing for adjusting the temperature of the nozzle portion in conjunction with the discharge timing of the liquid. The generation of satellites and splashes can thereby be inhibited.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
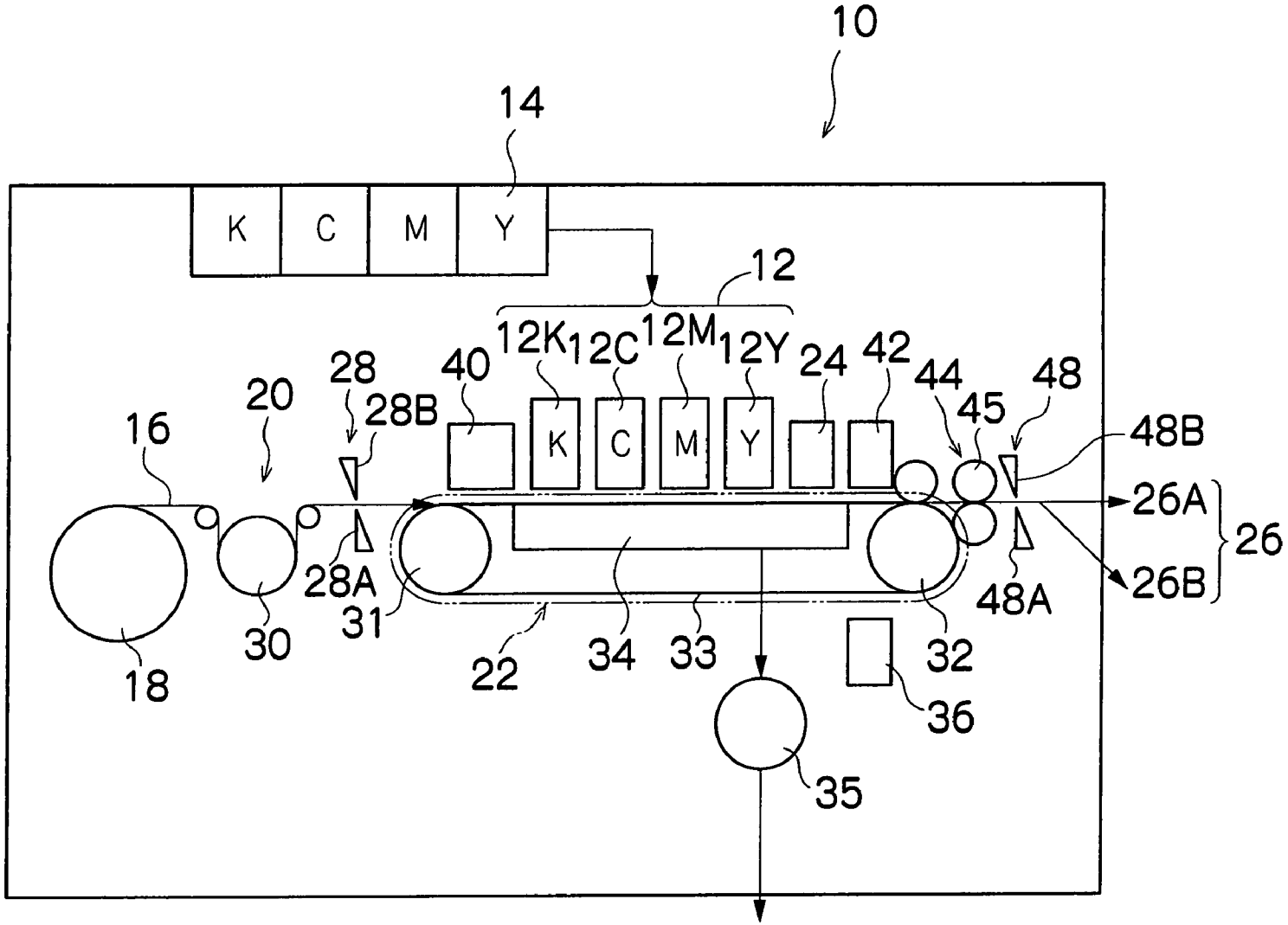
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown in FIG. 1, but shown as a motor 100 in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
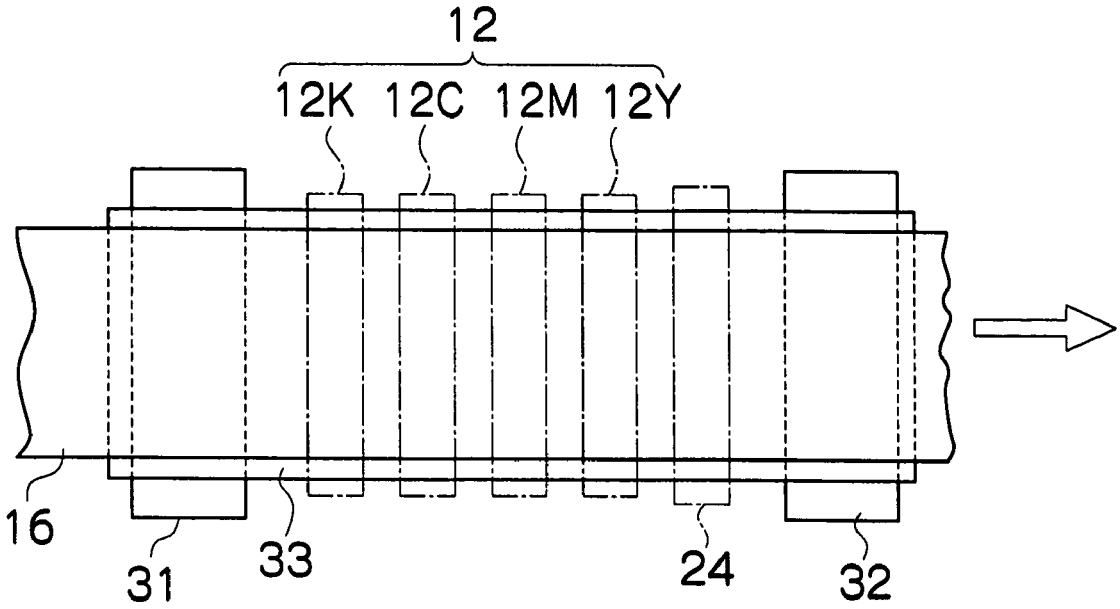
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. Although the details of the configuration are not depicted, each of the print heads 12K, 12C, 12M, and 12Y is composed of a line head, in which a plurality of ink-droplet ejection orifices (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Cross-Sectional Structure of the Area Around the Nozzles

Figure 3:
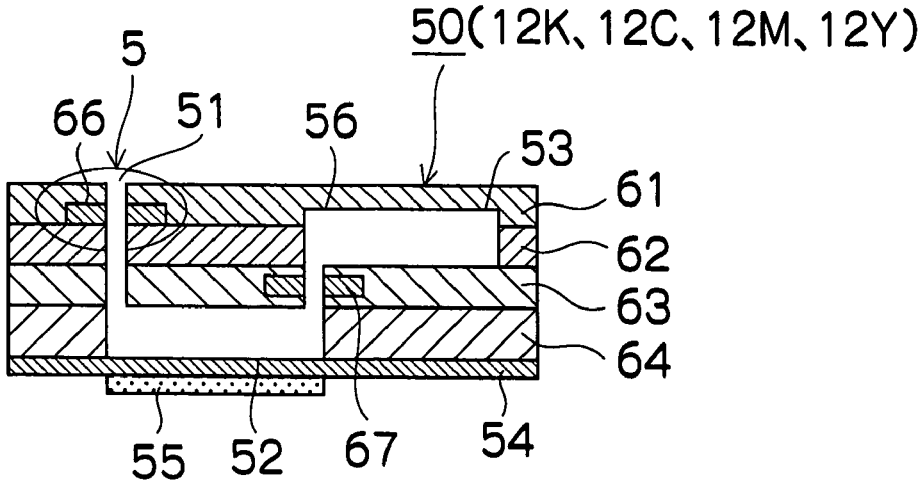
FIG. 3 is a cross section showing the schematic structure of an ink flow channel formed in the print head.

FIG. 3 is a cross-sectional view showing the schematic structure of an ink flow channel formed in each of the print heads 12K, 12C, 12M, and 12Y (hereinafter these are indicated by the key symbol 50, which represents all the print heads). In FIG. 3, the key symbol 51 is a nozzle for discharging ink, 52 is a pressure chamber, 53 is a common flow channel, 54 is a vibration plate, and 55 is an actuator.

The pressure chamber 52 provided to the nozzle 51 is connected to the common flow channel 53 by way of a supply channel 56. The ink delivered from the ink storing/loading unit 14 passes through the common flow channel 53 and is fed to the pressure chamber 52. The actuator 55 provided with a discrete electrode (not shown) is joined to the vibration plate 54, which constitutes the bottom surface of the pressure chamber 52; the actuator 55 is deformed by applying drive voltage to the discrete electrode; and pressure is applied to the ink inside the pressure chamber 52 to discharge the ink from the nozzle 51. In other words, a method that ejects ink droplets by deforming the actuator 55 represented by a piezo-element (piezoelectric element) is adopted in the present embodiment.

As shown in the diagram, the print head 50 of the present embodiment is configured such that an ink flow channel is formed as a layered structure of plate members in which holes and grooves are formed by etching or the like in SUS plates or other thin plate members. A structure in which four plate members are arranged in the layers on the vibration plate 54 is shown in FIG. 3. In other words, the plate members have a structure in which the following are layered: a first flow channel plate channel (nozzle layer) 61 including the discharge port of nozzle 51, a second flow channel plate 62 forming the side surface of the common flow channel 53, a third flow channel plate (supply channel layer) 63 including the supply channel 56, and a fourth flow channel plate 64 forming the side surface of the pressure chamber 52.

As shown in the diagram, a first heater (hereinafter referred to as "nozzle heater") 66 is provided to the area around the flow channel of the nozzle 51 in the first flow channel plate (nozzle layer) 61 for forming the flow channel that connects to the discharge port of nozzle 51. A second heater (hereinafter referred to as "supply channel heater") 67 is provided to the area around the supply channel 56 in the third flow channel plate 63 that forms the supply channel 56 for connecting the pressure chamber 52 and the common flow channel 53.

Figure 4:
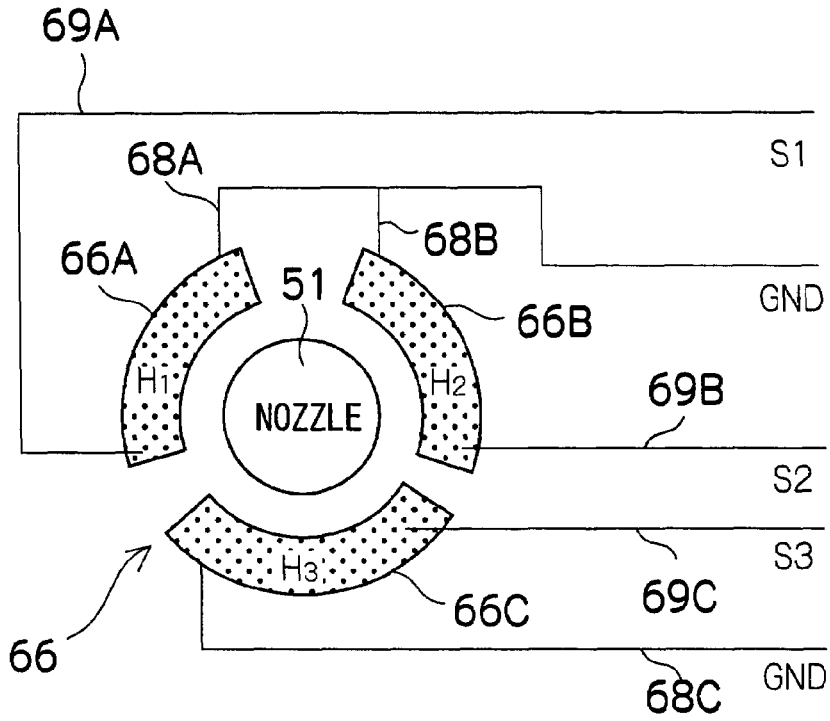
FIG. 4 is a plan view showing a structural example a nozzle heater.

FIG. 4 is a plan view showing a structural example the nozzle heater 66. The nozzle heater 66 is composed of a plurality of heater blocks (three blocks in FIG. 4) 66A, 66B, and 66C, and these heater blocks 66A to 66C are structured so as to be disposed along the circumference surrounding the area around the flow channel of nozzle 51. Each heater block 66A to 66C has a configuration in which the electrodes 68A, 68B, and 68C, which correspond to the ground lines, are connected to the electrodes 69A, 69B, and 69C, which correspond to the signal lines. These blocks 66A to 66C produce heat by the application of a predetermined voltage across these electrodes.

Figure 5:
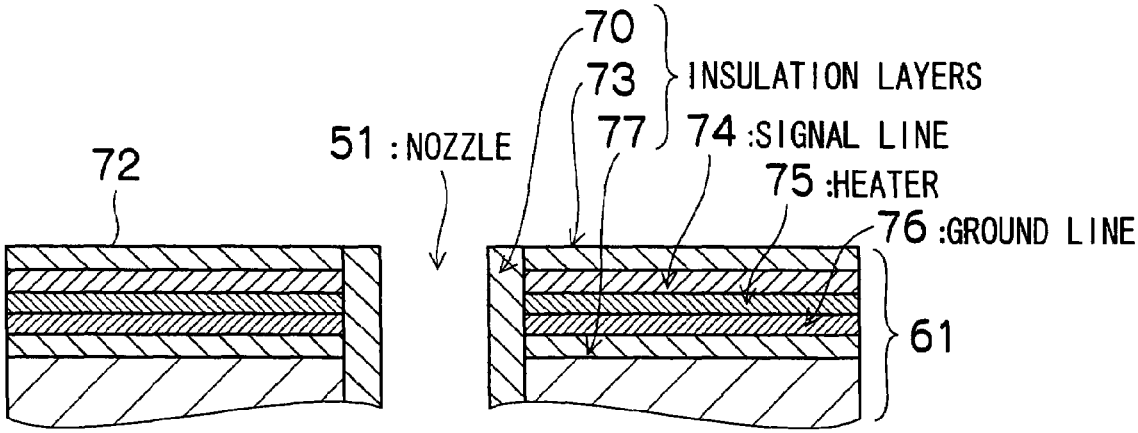
FIG. 5 is an enlarged cross-sectional view of the vicinity of the nozzles.

FIG. 5 is an enlarged view (an enlarged view of the portion indicated by the key symbol 5 in FIG. 3) of the vicinity of the tip of the nozzle. As shown in the diagram, the area around the flow channel of nozzle 51 is composed of an insulation layer 70. An insulation layer 73 is disposed on the uppermost layer of a discharge surface 72; and arranged in order in the layers below are a signal line 74, a heater (heater) 75, and a ground line 76. An insulation layer 77 is disposed below the ground line 76.

The wiring portion of the signal line 74 and the ground line 76 is composed of, for example, an aluminum (Al) film with a thickness of 0.8 μm, a wiring width of 5 μm, and a wiring interval also of 5 μm. It is apparent that the configuration of the wiring portion is not limited to this option alone, and it is also possible to use a metal other than aluminum.

The heater 75 is composed of the ternary alloy Ta—Si—O, for example, but may also be composed of a single layer of Ta, TaN, or the like. The insulation layers 70, 73, and 77 may be composed of an inorganic film of $SiO_2$ with a thickness of 0.5 μm, but also possible is Cytop (product name, manufactured by Asahi Glass Company) or another fluororesin. In such a case as well, the thickness is preferably about 0.5 μm or less.

The structure of the nozzle heater 66 is described in FIGS. 4 and 5, but the structure of the supply channel heater 67 indicated by the key symbol 67 in FIG. 3 is the same as the structure of the nozzle heater 66, so a description has been omitted.

System Structure

Figure 6:
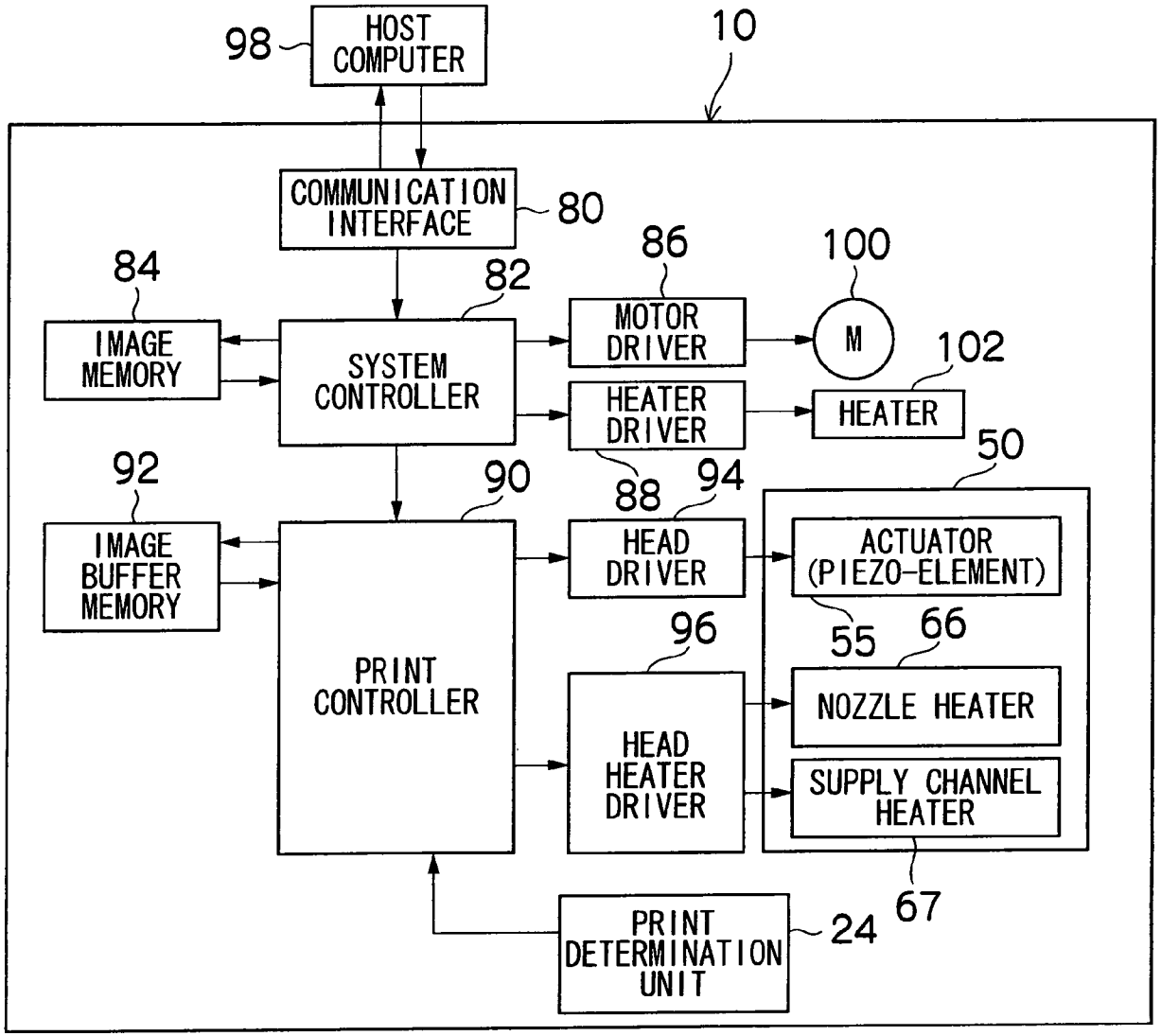
FIG. 6 is a block diagram of the principal components showing the system configuration of the inkjet recording apparatus.

FIG. 6 is a block diagram of the principal components showing the system configuration of the inkjet recording apparatus 10. The inkjet recording apparatus 10 has a communication interface 80, a system controller 82, an image memory 84, a motor driver 86, a heater driver 88, a print controller 90, an image buffer memory 92, a head driver 94, a head heater driver 96, and other components.

The communication interface 80 is an interface unit for receiving image data sent from a host computer 98. A serial interface such as USB, IEEE1394, Ethernet, wireless network, or a parallel interface such as a Centronics interface may be used as the communication interface 80. A buffer memory (not shown) may be mounted in this portion in order to increase the communication speed. The image data sent from the host computer 98 is received by the inkjet recording apparatus 10 through the communication interface 80, and is temporarily stored in the image memory 84. The image memory 84 is a storage device for temporarily storing images inputted through the communication interface 80, and data is written and read to and from the image memory 84 through the system controller 82. The image memory 84 is not limited to memory composed of a semiconductor element, and a hard disk drive or another magnetic medium may be used.

The system controller 82 controls the communication interface 80, image memory 84, motor driver 86, heater driver 88, and other components. The system controller 82 has a central processing unit (CPU), peripheral circuits therefor, and the like. The system controller 82 controls communication between itself and the host computer 98, controls reading and writing from and to the image memory 84, and performs other functions, and also generates control signals for controlling a heater 102 and the motor 100 in the conveyance system.

The motor driver (drive circuit) 86 drives the motor 100 in accordance with commands from the system controller 82. The heater driver (drive circuit) 88 drives the heater 102 of the post-drying unit 42 or the like in accordance with commands from the system controller 82.

The print controller 90 has a signal processing function for performing various tasks, compensations, and other types of processing for generating print control signals from the image data stored in the image memory 84 in accordance with commands from the system controller 82 so as to apply the generated print control signals (print data) to the head driver 94. Required signal processing is performed in the print controller 90, and the ejection timing and ejection amount of the ink-droplets from the print head 50 are controlled by the head driver 94 on the basis of the image data. Desired dot sizes and dot placement can be brought about thereby.

The print controller 90 is provided with the image buffer memory 92; and image data, parameters, and other data are temporarily stored in the image buffer memory 92 when image data is processed in the print controller 90. The aspect shown in FIG. 6 is one in which the image buffer memory 92 accompanies the print controller 90; however, the image memory 84 may also serve as the image buffer memory 92. Also possible is an aspect in which the print controller 90 and the system controller 82 are integrated to form a single processor.

The head driver 94 drives actuators for the print heads 12K, 12C, 12M, and 12Y of the respective colors on the basis of the print data received from the print controller 90. A feedback control system for keeping the drive conditions for the print heads constant may be included in the head driver 94.

The head heater driver 96 generates a signal for driving the nozzle heater 66 and the supply channel heater 67 in accordance with a command from the print controller 90. Control of the discharge drive timing for the ink and the heating timing for the nozzle heater 66 and the supply channel heater 67 is described later.

The image data that is to be printed is inputted from the exterior by way of the communication interface 80 and accumulated in the image memory 84. At this stage, the RGB image data is stored in the image memory 84.

The image data accumulated in the image memory 84 is sent to the print controller 90 by way of the system controller 82 and converted to the dot data for each color by a known random dither algorithm or another technique in the print controller 90. In other words, the print controller 90 carries out a routine for converting the inputted RGB image data to dot data for the four colors YCMK. The dot data generated by the print controller 90 is accumulated in an image buffer memory 92.

The head driver 94 generates a drive control signal for the print head 50 on the basis of the dot data stored in the image buffer memory 92. Ink is discharged from the nozzle 51 in the print head 50 by applying the drive control signal generated by the head driver 94 to the print head 50. An image is formed on the recording paper 16 by controlling the ink discharge from the print head 50 in synchronization with the conveyance velocity of the recording paper 16.

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 90.

Next, the timing for adjusting the temperature of the ink in the inkjet recording apparatus 10 configured as described above is described.

Timing for Adjusting the Temperature with Emphasis on the Fluid Phenomenon

Figures 7A, 7B, 7C, 7D, 7E, 7F, 7G, 7H, 7I, 7J:
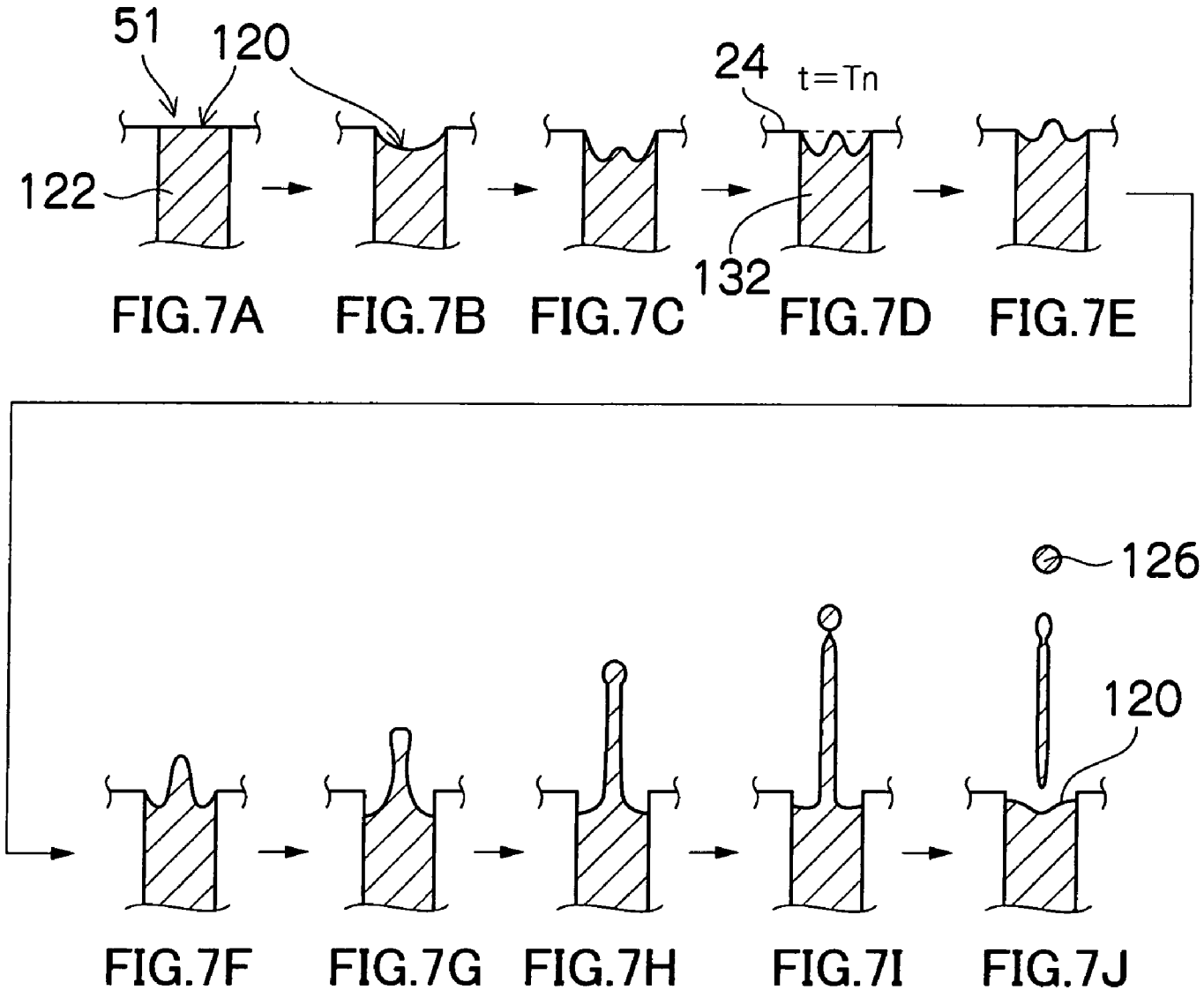
FIGS. 7A to 7J are schematic diagrams showing the discharge process of ink droplets from a nozzle.

FIGS. 7A to 7J are schematic diagrams showing an example of the discharge process of ink droplets by means of pull-push-pull meniscus control. The series of discharge processes shown in the diagram are realized by the drive control of the actuator 55. First, a mild pulling action is performed to reduce pressure prior to ink discharge, and the meniscus 120 (the boundary between the ink 122 inside the nozzle 51 and the outside air) is endowed with a predetermined shape (FIGS. 7A and 7B). Discharge action is vigorously carried out from this state (FIGS. 7C to 7H), a pulling action is once again performed after discharge, the ink droplet 126 is separated into predetermined sizes, and the vibration of the meniscus 120 is inhibited (FIGS. 7I to 7J).

The state shown in FIG. 7D in such a fluid phenomenon, in other words, the time t=Tn at which the ink 122 departs from the discharge surface (nozzle surface) 124 is set as the reference of the temperature adjustment timing.

Figure 8:
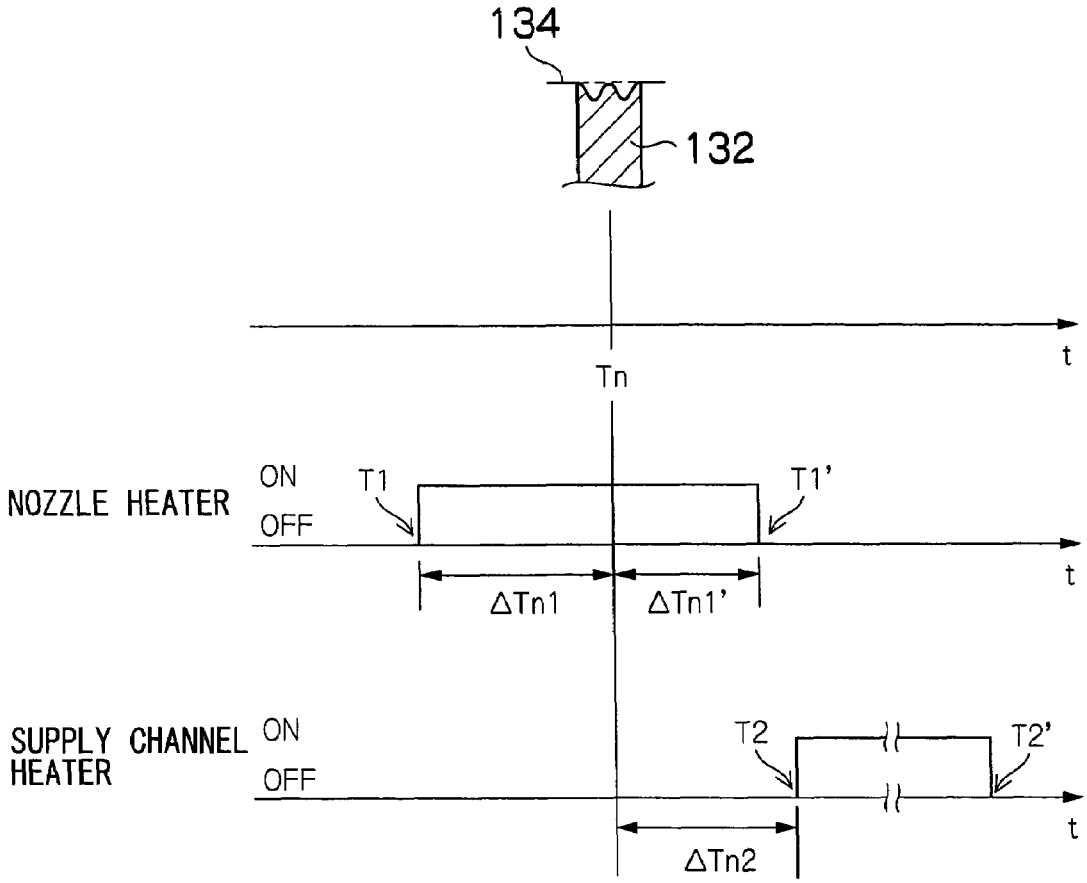
FIG. 8 is timing chart showing the drive timing of the nozzle heater and supply channel heater.

FIG. 8 is an example of a timing chart showing the drive timing of the nozzle heater 66 and supply channel heater 67. In this section, the state in FIG. 7D is defined as "discharge."

The drive start timing T1 of the nozzle heater 66 is 1 μs to 100 μs prior to Tn. When ΔTn1=T1−Tn, then −100 μs≦ΔTn1≦−1 μs. Here, the condition that ΔTn1≦−1 μs indicates that 1 μs or greater is required to heat and increase the temperature of the ink in the area around the nozzle.

The drive end timing T1' for the nozzle heater 66 is from 20 μs prior to Tn until 50 μs thereafter. When ΔTn1'=T1'−Tn, then −20 μs≦ΔTn1'≦50 μs. The reason for switching off the nozzle heater 66 immediately prior to or immediately after discharge (−20 μs to +20 μs) is to shorten the heating time and reduce the amount of heat. A preferable aspect in one in which the nozzle heater 66 is switched off after discharge (+20 μs to +50 μs) in order to reduce the viscosity of the ink even during refilling so that refilling after discharge is performed quickly.

The drive start timing T2 of the supply channel heater 67 is 1 μs to 100 μs after Tn. When ΔTn2=T2−Tn, then 1 μs≦ΔTn1≦100 μs. Here, the condition that ΔTn1≧1 μs indicates that 1 μs or greater is required to heat and increase the temperature of the ink in the supply channel 56.

Refilling after discharge has begun is started in 0 to 100 μs, or often 0 to 50 μs, so the driving of the supply channel heater 67 is started with the above timing. The drive end timing T2' for the supply channel heater 67 is determined based on the drive frequency of the actuator 55.

The fact that at least 1 μs of heating time is required to increase the temperature of the ink with the nozzle heater 66 and the supply channel heater 67 is derived from calculating the temperature distribution inside the nozzle as shown below.

Figure 9:
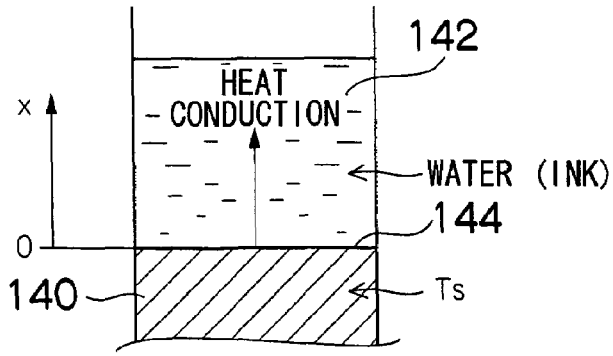
FIG. 9 is a diagram describing the calculation conditions for heat conduction.

In the calculation, an approximation by the thermal transmission (a model with no convection) of a semi-infinite fluid is applied. The coordinate axis of the position x is set with the boundary surface 144 as the reference for a low-temperature fluid (semi-infinite fluid 142), which is in contact with a temperature source 140, as shown in FIG. 9. As the initial condition, let the semi-infinite fluid 142 be uniform at the initial temperature T0, and let Ts be the temperature of the plane x=0 at time τ=0. Ts remains constant thereafter.

As for the temperature T (τ, x) at time τ and position x, the following formula (1) is valid with the above conditions:

$$\frac{T(\tau, x) - T_S}{T_0 - T_S} = erf(\beta), \tag{1}$$

where erf (β) is an error function expressed by the following formula (2):

$$erf(\beta) = \frac{2}{\sqrt{\pi}} \cdot \int_{\gamma}^{\beta} \exp(-\beta^2) \cdot d\beta, \tag{2}$$

where β is expressed by the following formula (3):

$$\beta = \frac{x}{2\sqrt{a \cdot \gamma}}. \tag{3}$$

In the formula (3), a is a thermal conductivity ($m^2/s$) expressed by the following formula (4):

$$a = \frac{\lambda}{\rho \cdot C_P} \tag{4}$$

where λ is thermal conductivity (W/(m·K)), ρ is density ($kg/m^3$), and $C_P$ is specific heat capacity (J/(kg·K)). In the case of water, λ=0.61, ρ=1000, and $C_P$=4180, so that $\alpha=1.46\times10^{-7}$.

The temperature T at time τ and in a position separated by an amount equivalent to x from the temperature source can be calculated using the above formulae (1) to (4).

The amount of heat Q ($J/m^2$) entering from the unit surface area of the surface during the time $\tau=0$ to $\tau$ is expressed in the following formula (5):

$$Q = 2 \cdot \lambda \cdot (T_S - T_0) \cdot \sqrt{\frac{\tau}{\pi \cdot a}} . \quad (5)$$

The required amount of heat can be calculated from the formula (5).

Figure 10:
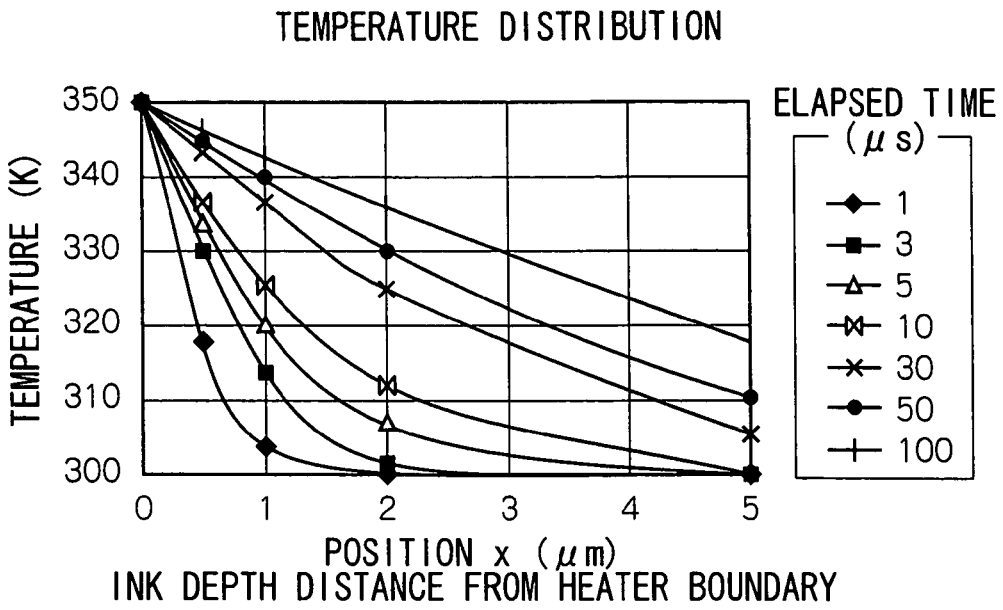
FIG. 10 is a graph showing the calculation results of the temperature distribution inside the nozzles.
Figure 11:
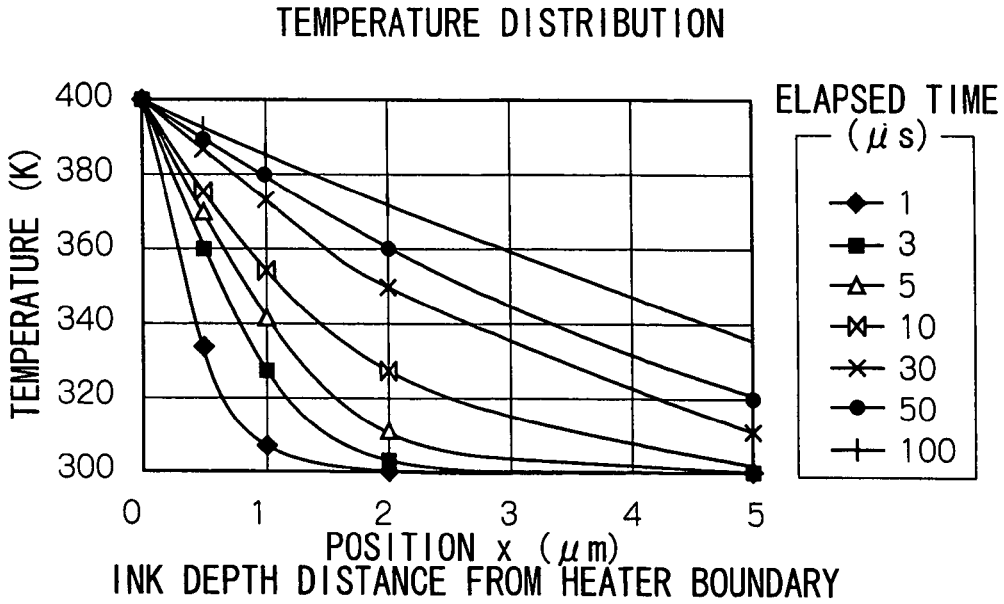
FIG. 11 is a graph showing the calculation results of the temperature distribution inside the nozzles.

The composition of a common water-based ink is 80% or more water, so assuming the liquid is water, the temperature distribution can be calculated. The calculation results when the initial temperature is $T_0$=300K and the boundary temperature is $T_S$=350K are shown in FIG. 10. The calculation results when the initial temperature is $T_0$=300K and the boundary temperature is $T_S$=400K are shown in FIG. 11.

From these graphs it is apparent that the temperature of the ink (water, for calculation purposes) with a thickness of 1 μm from the heater boundary can be increased in a heating time of 1 μs. Furthermore, the range of distances in which an increase in temperature can be observed within several tens of microseconds is several micrometers from the heater boundary. Assuming the nozzle diameter is about 30 μm, the temperature can be increased on an external periphery of about 10% with respect to the nozzle diameter.

Figure 12:
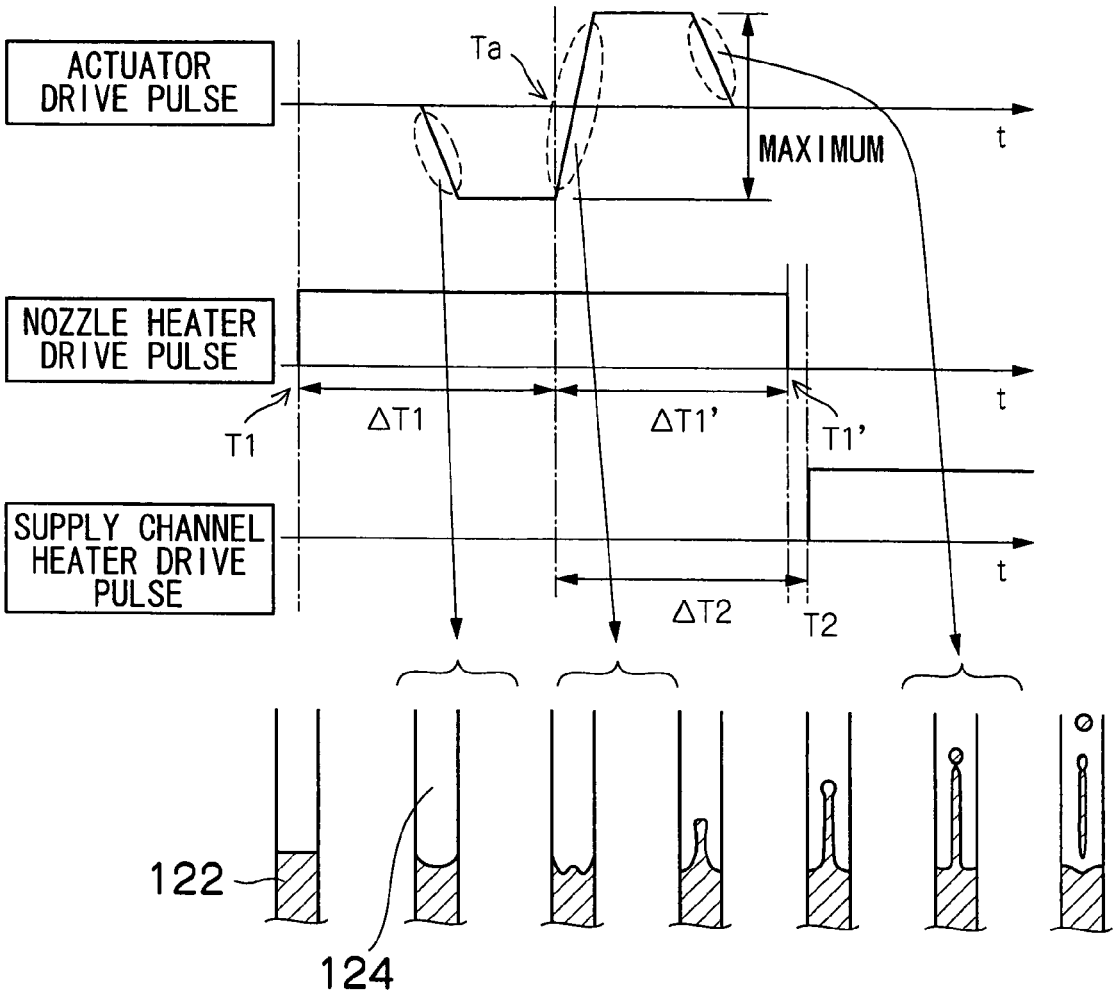
FIG. 12 is a diagram showing the actuator drive waveform and the correlation between the movement of the ink during discharge and a timing chart showing the drive timing of the nozzle heater and the supply channel heater.

Timing for Adjusting the Temperature with Emphasis on the Actuator Drive Waveform FIG. 12 is a diagram showing the correlation between the movement of the ink during discharge and a timing chart showing the drive timing of the nozzle heater 66 and the supply channel heater 67 with emphasis on the actuator drive waveform. In the diagram, the horizontal axis shows time, and the vertical axis shows voltage.

Ta is the actuator drive timing when ink 122 is discharged from the nozzle surface 124, as shown in FIG. 12, and Ta is the reference for heater control. The action of causing ink 122 to be discharged from the nozzle surface 124 is realized by driving the actuator to reduce the volume of the pressure chamber 52. In other words, the timing whereby the ink 122 departs from the nozzle face 124 to the outside is within the drive interval for displacing the actuator 55 in the direction of reducing the volume of the pressure chamber, and when there is a plurality of these drive intervals, the departure that occurs among these is the interval with the maximum difference in electrical potential or the maximum slope of the drive pulse.

Thus, emphasis is placed on the location where the change in voltage is the largest, or the location where the time derivative of the change in voltage is the largest in a series of voltage drives, and the timing of the actuator drive for realizing the discharge operation is set as the reference Ta. Also, the drive timing for the nozzle heater and the supply channel heater are set at approximately the reference Ta.

More specifically, the drive timing for each heater is set by substituting Tn with Ta in the same manner as the example described in FIG. 8.

Figure 13A:
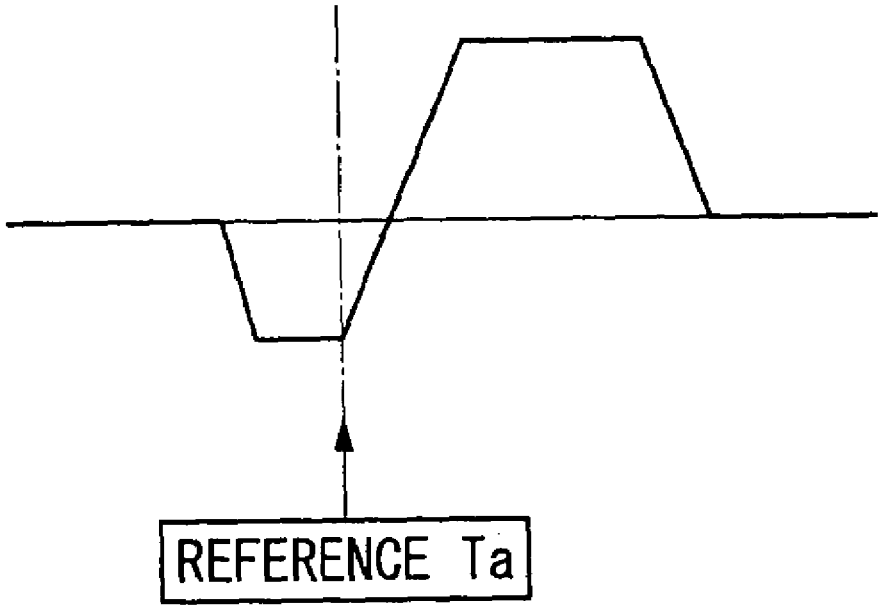
FIGS. 13A and 13B are diagrams showing other waveform examples of the actuator drive pulse.
Figure 13B:
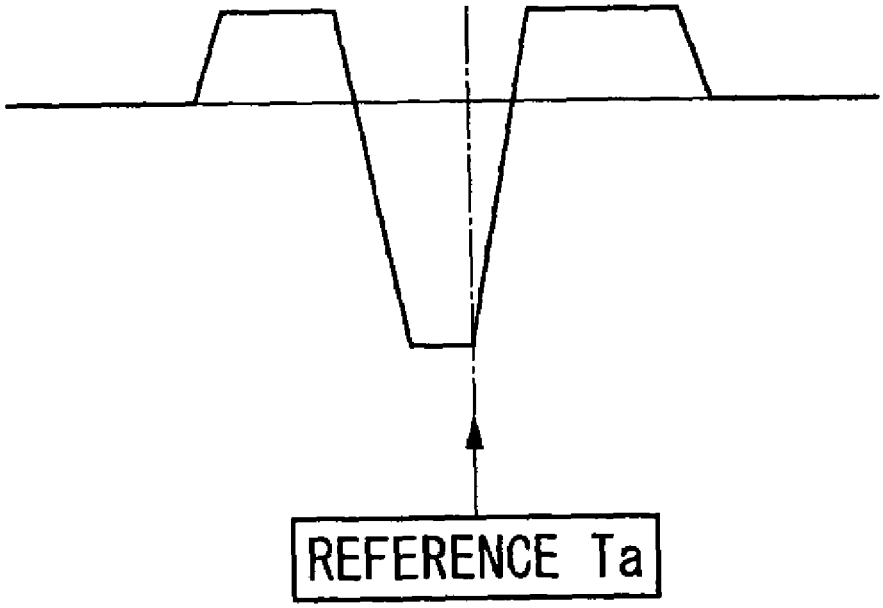

The actuator drive waveform is not limited to the example in FIG. 12. FIGS. 13A and 13B show other waveform examples for the actuator drive pulse. A variety of types of actuator drive waveforms are possible, but in any of the cases, a suitable time is decided as the reference time Ta from among the time periods in which the difference in electric potential and slope is maximal. The time is not limited to the Ta shown in FIGS. 12 and 13, and also possible is an aspect in which the time at which the voltage is zero is set as the reference time Ta, for example.

Evaluation of Thermostatic Amount of Heat

The required amount of heat is calculated using the above formula (5). Assuming that the liquid is water, the initial temperature $T_0$ is 300K. The shape of the nozzle is assumed to be a cylindrical shape with a radius of 15 μm, a height of 50 μm, and an internal surface area of $4.7\times10^{-9}$ $m^2$. The calculation results when the heating temperature is 350K and 400K are shown in FIG. 14.

Figure 14:
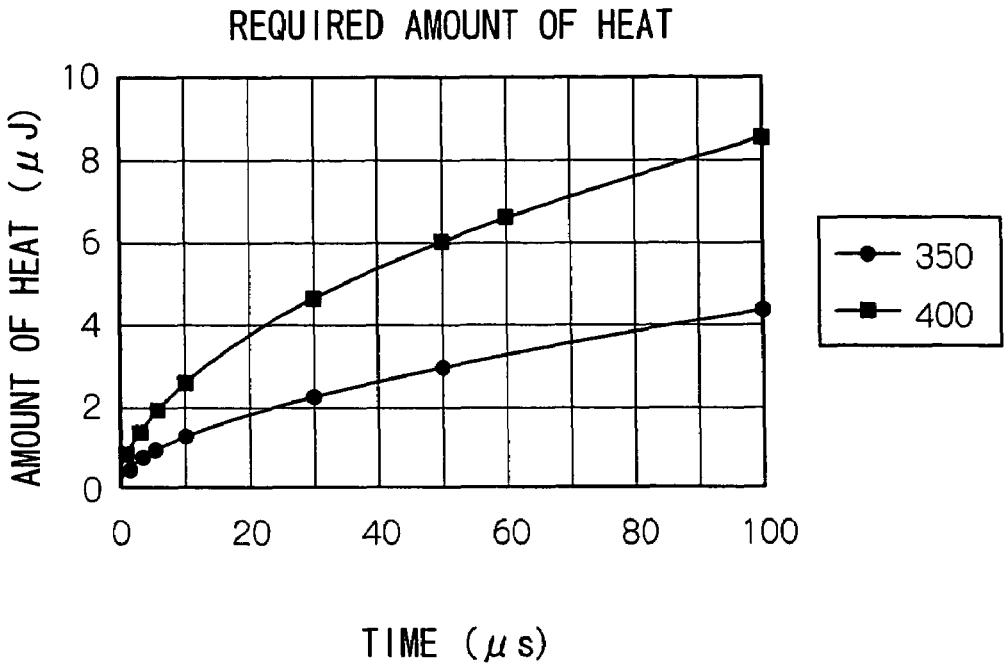
FIG. 14 is a graph showing the calculation results of the required amount of heat.

As shown in FIG. 14, the required amount of heat in a range of several tens of microseconds is several microjoules. Even if the head is warmed about the same as the ink, the amount of heat of the heater is about 10 μJ, and is 20 μJ or less even if estimated high. From this viewpoint, the temperature adjustment time by the nozzle heater 66 and the supply channel heater 67 is set to 100 μs or less.

Temperature Dependency Characteristics of the Physical Properties of Ink

Figure 15:
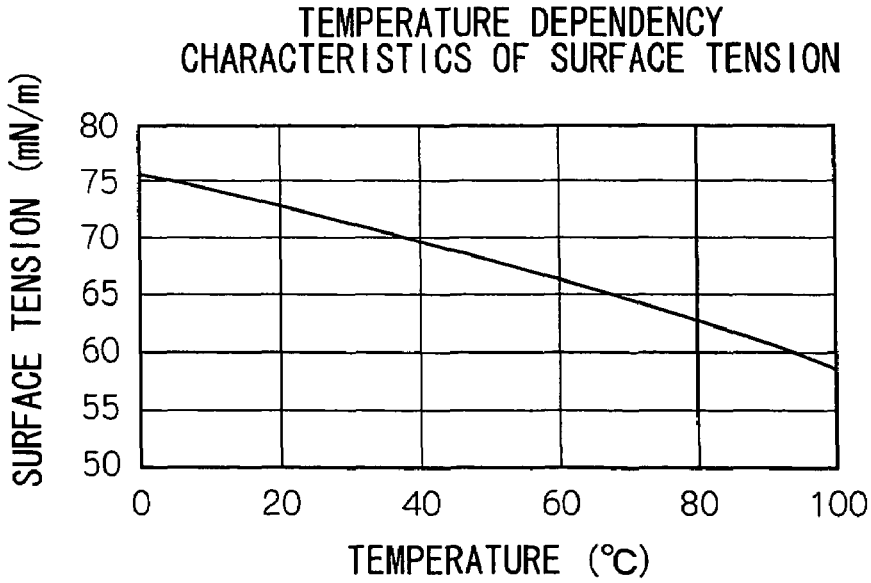
FIG. 15 is a graph showing the relationship between the surface tension and the temperature for a certain ink.
Figure 16:
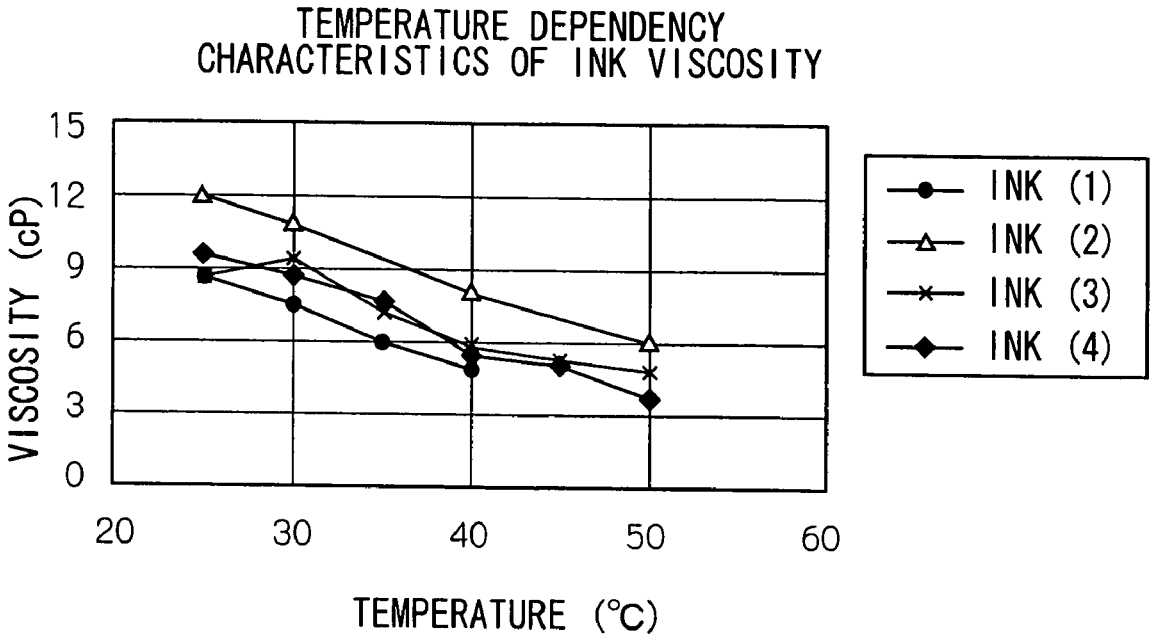
FIG. 16 is a graph showing temperature dependency characteristics of the respective ink viscosities for a plurality (four types) of inks.

Temperature-induced changes in the physical properties of ink vary depending on the type of ink. FIG. 15 is a graph showing the relationship between the surface tension and the temperature for a certain ink. FIG. 16 is a graph showing the temperature dependency characteristics of the respective ink viscosities for four types of inks. As the temperature of the ink increases, the surface tension lessens and viscosity tends to decrease, as shown in these diagrams.

Figure 17:
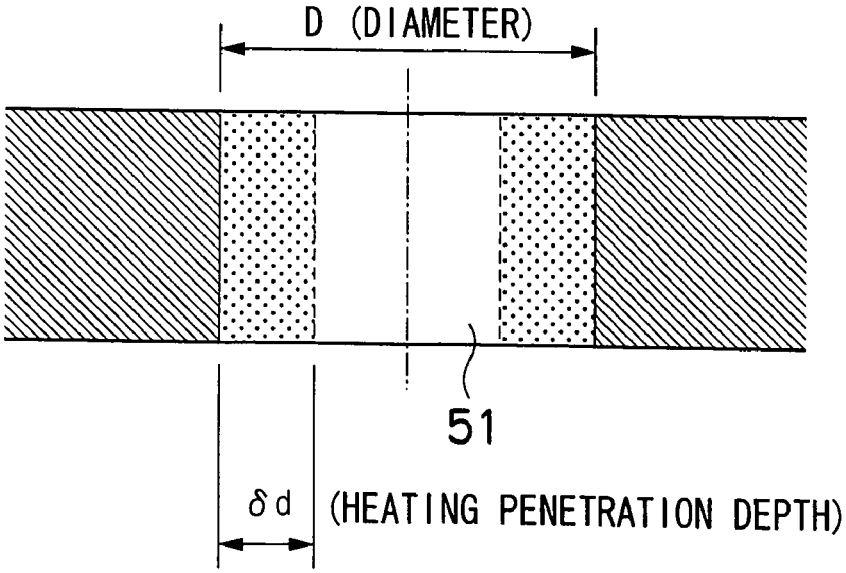
FIG. 17 is an enlarged cross-sectional view of the principal components of the nozzles used to describe the heating penetration depth.

It was discovered through experimentation that ink can be discharged if it is possible to reduce the viscosity of that portion of the ink inside the nozzle 51 which is in the vicinity of the contact surface with the nozzle wall. In other words, when D is the diameter of the nozzle 51 and the heating penetration depth from the nozzle wall is δd as shown in FIG. 17, ink can be satisfactorily discharged if the heating penetration depth satisfies $0.05 \leqq \delta d/D$, and the heating energy can be reduced by half if the heating penetration depth satisfies $\delta d/D \leqq 0.15$.

The following Table 1 shows the evaluation results of the ink discharging conditions, the relative ratio of the heating energy, and the evaluation results of the energy-saving effects, in the experiments performed while the conditions of δd/D were changed.

TABLE 1

| δd/D | Ink Discharging Condition | Relative Ratio of Heating Energy | Energy-Saving Effect |
|---|---|---|---|
| 1 | Excellent | 1 | Poor |
| 0.45 | Excellent | 0.99 | Poor |
| 0.35 | Excellent | 0.91 | Poor |
| 0.25 | Excellent | 0.75 | Poor |
| 0.15 | Excellent | 0.51 | Good |
| 0.07 | Excellent | 0.2604 | Excellent |
| 0.05 | Good | 0.19 | Excellent |
| 0.03 | Poor | 0.1164 | Excellent |

As seen from the experimental results shown in Table 1, both the ink discharging conditions and the energy-saving effects are satisfactory when the heating penetration depth satisfies $0.05 \leqq \delta d/D \leqq 0.15$.

An example of Temperature Control with Consideration for the Physical Properties of the Ink Temperature control in the present embodiment will now be described using a more specific example. From a simulation by numerical calculation, it was found that ink can be discharged if the ink has a low viscosity of 5 cP or less at 1 μm from the nozzle wall, even if the ink has high viscosity.

Figure 18:
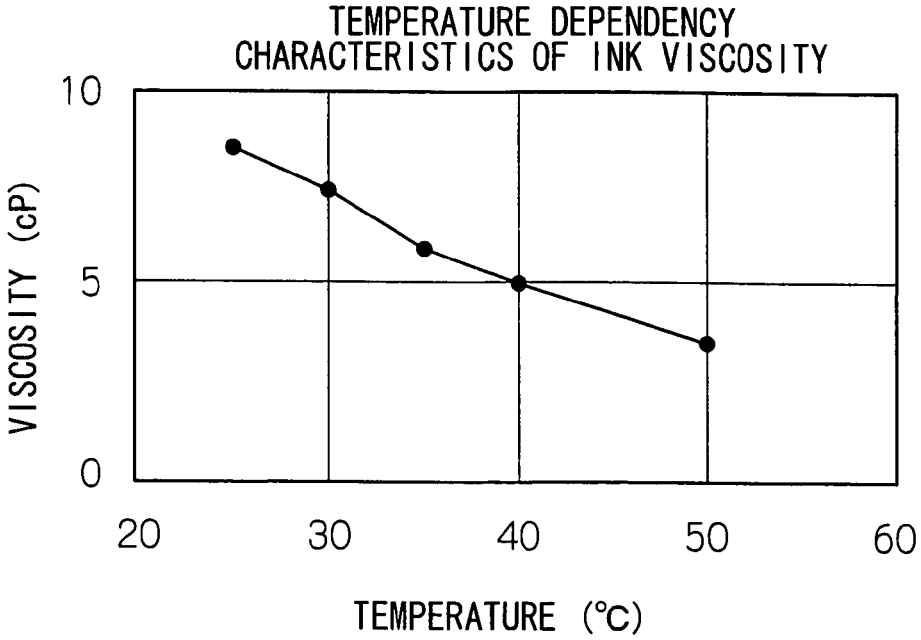
FIG. 18 is a graph showing an example of the temperature dependency characteristics of the ink viscosity.

As already described, it is apparent that, as a characteristic of the ink, the viscosity is decreased when the temperature is increased. Here, ink with the temperature characteristics of viscosity shown in FIG. 18 is used. With the ink shown in the graph, the viscosity reaches 5 cP or less at 40° C. or higher.

Figure 19:
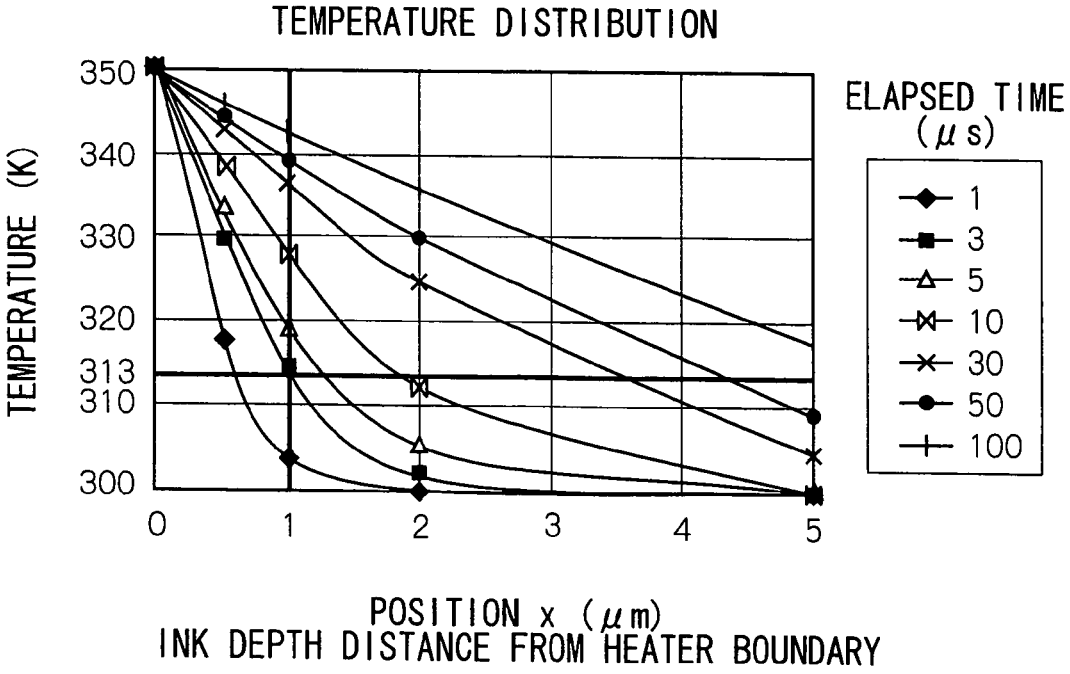
FIG. 19 is a graph showing the relationship between the temperature and the ink depth (distance) from the nozzle wall (heater boundary) with elapsed time as a parameter.

The increase in the ink temperature in the nozzle portion due to the nozzle heater 66 is obtained by calculating the thermal conduction. FIG. 19 is a graph showing the relationship between the temperature and the ink depth (distance) from the nozzle wall (heater boundary) when the nozzle wall is kept at 350K, with the elapsed time (μs) as a parameter. In accordance with this diagram, it is apparent that 3 μs or more are required in order to increase the temperature of the ink 1 μm from the nozzle wall to 40° C. or higher (5 cP or less). Therefore, with this ink, the drive start timing T1 for the nozzle heater 66 must be set to 3 μs or more prior to Ta or Tn.

Thus, the required heating temperature and temperature rising time are calculated from the physical properties of the ink to be used, the nozzle conditions, and other factors, and the drive timing of the nozzle heater 66 is set in accordance with calculation results. The drive timing of the supply channel heater 67 is also set in accordance with the same calculations.

Figure 20:
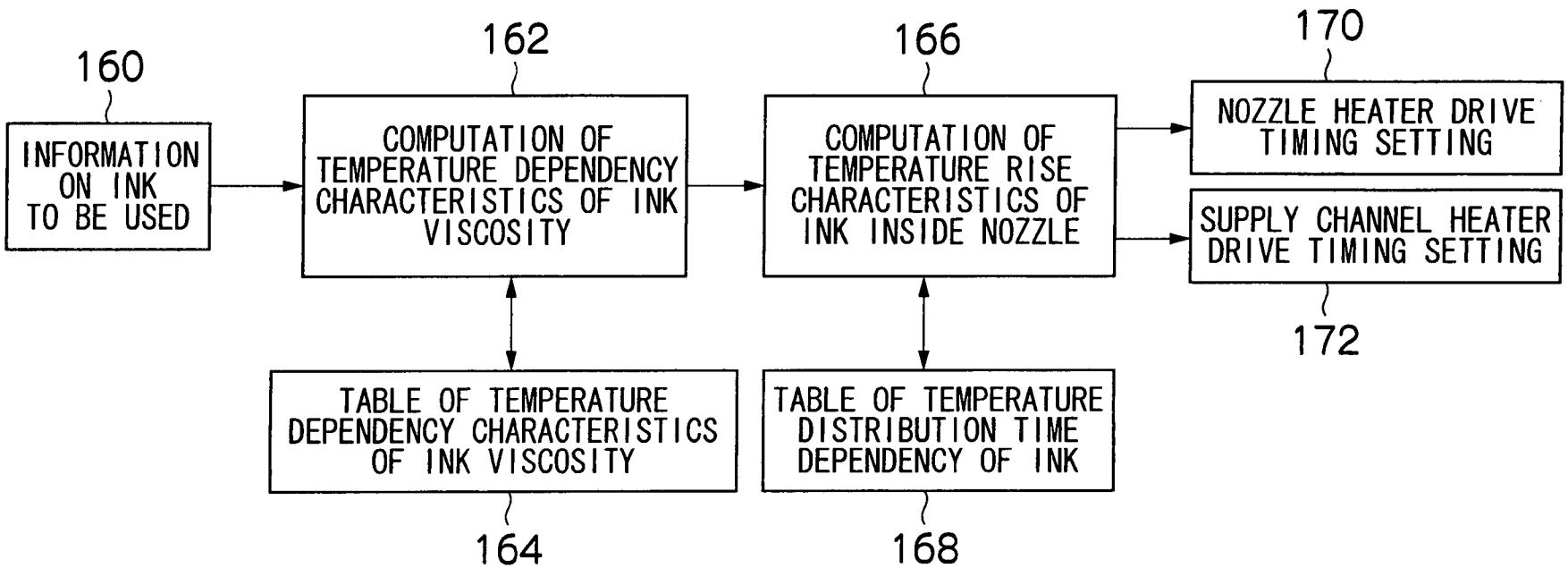
FIG. 20 is a processing block diagram related to the processing for setting the heater drive timing.

FIG. 20 is a processing block diagram related to the processing for setting the heater drive timing. The inkjet recording apparatus 10 has an ink information acquisition unit 160 for acquiring information about the ink to be used, a first computational processing unit 162 for computing the temperature dependency characteristics of the ink viscosity, a first table storage unit 164 for storing table data showing the temperature dependency characteristics of the viscosity of at least one type (preferable a plurality of types) of ink, a second computational processing unit 166 for calculating the ink temperature rise characteristics inside the nozzle, a second table storage unit 168 for storing table data showing the temperature dependency characteristics of the temperature distribution in the ink, and timing setting units 170 and 172 for setting the respective drive timings of the nozzle heater 66 and supply channel heater 67 on the basis of the computational results of the first computational processing unit 162 and the second computational processing unit 166.

The processing function shown in FIG. 20 may be performed by the system controller 82 described in FIG. 6, the print controller 90, or a combination of these.

Figure 21:
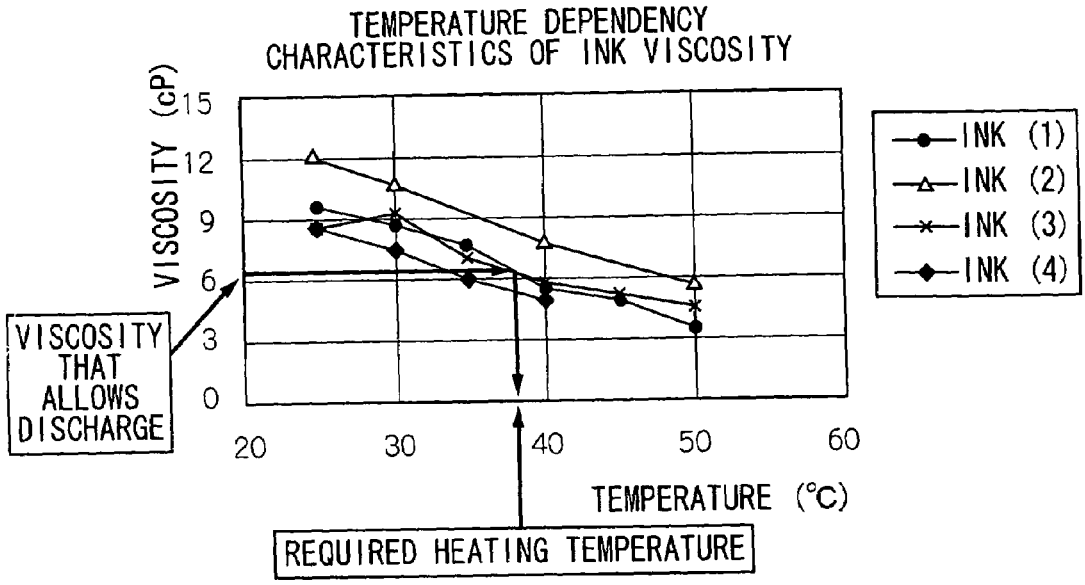
FIG. 21 is a diagram used to describe the method for calculating the required heating temperature in order to obtain a predetermined viscosity that allows discharge, from the table showing the temperature dependence of the ink viscosity.

Information about the ink to be used is obtained from the ink information acquisition unit 160, and the temperature dependency characteristics of the viscosity of the ink to be used are calculated in the first computational processing unit 162, as shown in FIG. 20. At this time, the first computational processing unit 162 refers to the table data stored in the first table storage unit 164, and the heating temperature (required heating temperature) that is required to obtain a viscosity that allows discharge is calculated for the appropriate ink, as shown in FIG. 21.

Figure 22:
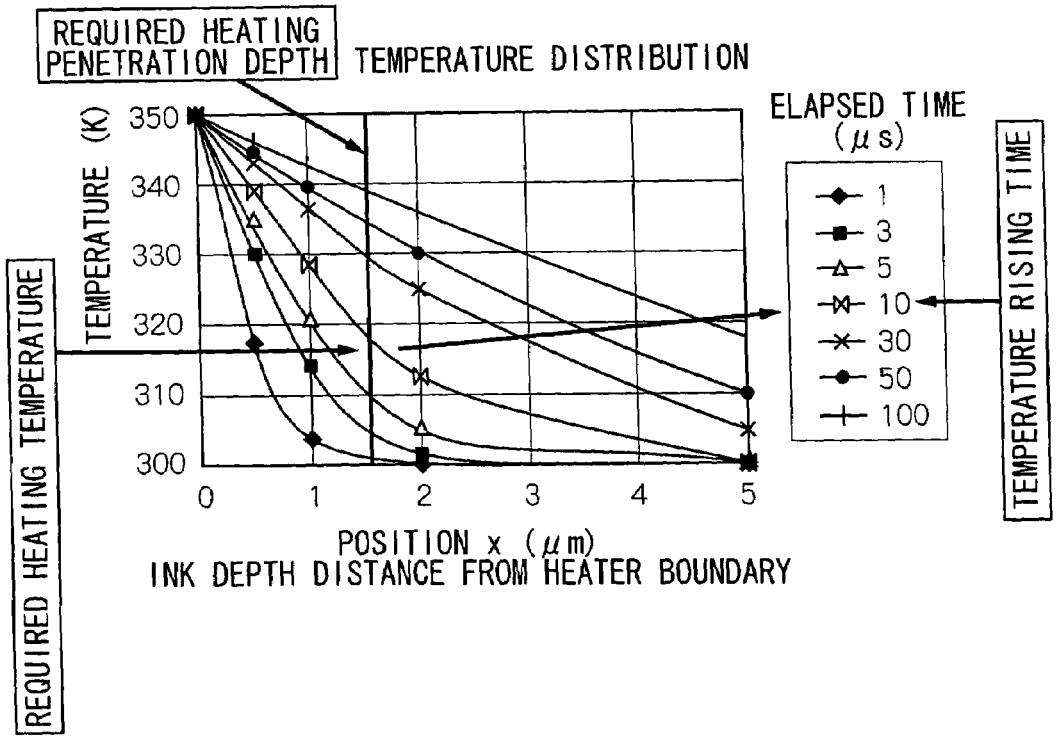
FIG. 22 is a diagram used to describe the method for calculating the required increase in temperature in order to increase the required heating penetration depth δd to the required heating temperature, from the table showing the temperature distribution.

The computational results of the first computational processing unit 162 shown in FIG. 20 are sent to the second computational processing unit 166. The second computational processing unit 166 refers to the table data stored in the second table storage unit 168, and the temperature rising time needed to increase the required heating penetration depth δd to the required heating temperature is calculated on the basis of the required heating temperature information and the required heating penetration depth δd information, as shown in FIG. 22.

The temperature increase information calculated in this manner is sent to the timing setting units 170 and 172 in FIG. 20, and the respective drive timings for the nozzle heater 66 and the supply channel heater 67 are set in accordance with the temperature rising time.

In accordance with the present embodiment, the nozzles are adjusted in conjunction with the ink discharge timing, so high-viscosity ink can be discharged with minimal heating energy. By storing information for a plurality of types of ink in the first table storage unit 164, a plurality of types of ink can be handled, and the temperature can be adjusted so that a suitable ink viscosity is achieved for allowing discharge in accordance with the type of ink to be used.

The heating control response characteristics are high, the discharge frequency is improved, and the amount of energy consumed can be reduced as are result of a structure in which solely locations with relatively large fluid resistance for ink are heated and the viscosity of the ink is locally reduced, as shown in FIG. 3.

Furthermore, the nozzle heater 66 and the supply channel heater 67 are separately provided in flow channel plates with differing layers, so the mutual temperature effects are reduced, heat can be effectively transferred to solely the areas around the nozzles and the individual flow channels (supply channels), and the effects of temperature control can be maintained. Even more effective is the use of 62 in FIG. 3 as a heat insulation layer, for example.

An inkjet recording apparatus 10 was described in the above embodiments, but the scope of application of the present invention is not limited to this option alone, and it is also possible to apply the present invention to various types of liquid discharge apparatuses such as an application apparatus whereby treatment fluid or another liquid is applied to a medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid discharge apparatus which discharges liquid from an orifice of a nozzle portion, comprising:

a nozzle-portion heating device which heats the nozzle portion; and a nozzle heating control device which controls a heating timing by the nozzle-portion heating device in accordance with a discharge drive timing for discharging the liquid from the orifice of the nozzle portion;

a computing device which calculates a temperature rising time needed to bring a viscosity of the liquid inside the nozzle portion to a predetermined value or less according to temperature dependency characteristics of the viscosity of the liquid to be discharged and temperature rise characteristics of the liquid inside the nozzle portion; and a timing setting device which sets a drive timing of the nozzle-portion heating device in accordance with the temperature rising time calculated by the computing device.

2. The liquid discharge apparatus as defined in claim 1, wherein the nozzle heating control device controls the nozzle-portion heating device so as to heat the liquid inside the nozzle portion at a predetermined heating penetration depth from a wall face of the nozzle portion to a predetermined temperature.

3. The liquid discharge apparatus as defined in claim 2, wherein the heating penetration depth δd satisfies the following formula:

$$0.05 \leqq \delta d/D \leqq 0.15,$$

where D is a diameter of the nozzle portion.

4. The liquid discharge apparatus as defined in claim 1, further comprising:

a first computational processing unit which determines a relationship between a desired viscosity and a required heating temperature of the liquid according to the temperature dependency characteristics of the viscosity of the liquid; and a second computational processing unit which determines the temperature rising time needed to heat the liquid to the required heating temperature according to the temperature rise characteristics of the liquid inside the nozzle portion.

5. The liquid discharge apparatus as defined in claim 4, wherein:

the first computational processing unit has a first table showing the temperature dependency characteristics of the viscosity of the liquid; and the second computational processing unit has a second table showing the temperature rise characteristics of the liquid inside the nozzle portion.

6. The liquid discharge apparatus as defined in claim 4, wherein the nozzle heating control device controls the nozzle-portion heating device so as to heat the liquid inside the nozzle portion at a predetermined heating penetration depth from a wall face of the nozzle portion to a predetermined temperature.

7. The liquid discharge apparatus as defined in claim 6, wherein the heating penetration depth δd satisfies the following formula:

$$0.05 \leqq \delta d/D \leqq 0.15,$$

where D is a diameter of the nozzle portion.

* * * * *